United States Patent [19]

Yen et al.

[11] Patent Number: 4,474,618

[45] Date of Patent: Oct. 2, 1984

[54] OVERNIGHT CLOUD AND COLOR IN LUBE DEWAXING USING PLATINUM ZEOLITE CATALYST

[75] Inventors: Jeffrey H. Yen, Swedesboro; Arthur W. Chester, Cherry Hill; Garwood, William E., Haddonfield, all of N.J.

[73] Assignee: Mobil Oil Corporation, New York, N.Y.

[21] Appl. No.: 520,953

[22] Filed: Aug. 8, 1983

[51] Int. Cl.[3] ..... C10G 45/62; C10G 45/64

[52] U.S. Cl. ..... 208/111; 208/120; 502/66

[58] Field of Search ..... 208/111, 120; 502/66

[56] References Cited

U.S. PATENT DOCUMENTS

| | | | |
|---|---|---|---|
| 3,853,747 | 12/1974 | Young | 208/111 |
| 3,980,550 | 9/1976 | Gorring et al. | 208/111 |
| 4,009,096 | 2/1977 | Pollitzer et al. | 208/111 |
| 4,137,146 | 1/1979 | Meyer | 208/60 |
| 4,148,750 | 4/1979 | Pine | 208/111 X |
| 4,169,783 | 10/1979 | Hilfman | 208/111 |
| 4,176,050 | 11/1979 | Chen et al. | 208/111 |

*Primary Examiner*—Delbert E. Gantz
*Assistant Examiner*—O. Chaudhuri
*Attorney, Agent, or Firm*—A. J. McKillop; M. G. Gilman; J. F. Powers, Jr.

[57] ABSTRACT

A highly dispersed platinum ZSM-5 catalyst used in hydrodewaxing lube stock yields a product with improved overnight cloud performance and lighter ASTM color.

9 Claims, 3 Drawing Figures

OVERNIGHT CLOUD AND COLOR IN LUBE DEWAXING USING PLATINUM ZEOLITE CATALYST

BACKGROUND OF THE INVENTION

1. Field of the Invention

This invention is concerned with the manufacture of high quality lubricating oils, and in particular with lubricating oils derived from petroleum distillate fractions. It is especially directed to the preparation of low pour point lubricating oils having improved overnight cloud performance and color from crude oils of high wax content. This invention is specifically directed to catalytically dewaxing a waxy distillate lubricating oil with a ZSM-5 zeolite catalyst containing a noble metal hydrogenation component.

2. Description of the Prior Art

Refining suitable petroleum crude oils to obtain a variety of lubricating oils which function effectively in diverse environments has become a highly developed and complex art. Although the broad principles involved in refining are qualitatively understood, the art is encumbered by quantitative uncertainties which require considerable resort to empiricism in practical refining. Underlying these quantitative uncertainties is the complexity of the molecular constitution of lubricating oils. Because lubricating oils for the most part are based on petroleum fractions boiling above about 450° F., the molecular weight of the hydrocarbon constituents is high and these constituents display almost all conceivable structure types. This complexity and its consequences are referred to in well-known treatises, such as, for example, in "Petroleum Refinery Engineering," by W. L. Nelson, McGraw-Hill Book Company, Inc., New York, N.Y., 1958 (Fourth Edition).

In general, the basic premise in lubricant refining is that a suitable crude oil, as shown by experience or by assay, contains a quantity of lubricant stock having a predetermined set of properties such as, for example, appropriate viscosity, oxidation stability, and maintenance of fluidity at low temperatures. The process of refining to isolate that lubricant stock consists of a set of subtractive unit operations which removes the unwanted components. The most important of these unit operations include distillation, solvent refining, and dewaxing, which basically are physical separation processes in the sense that if all the separated fractions were recombined one would reconstitute the crude oil.

A refined lubricant stock may be used as such as a lubricant, or it may be blended with another refined lubricant stock having different properties. Or, the refined lubricant stock prior to use as a lubricant, may be compounded with one or more additives which function, for example, as antioxidants, extreme pressure additives, and V.I. improvers.

For the preparation of a high grade distillate lubricating oil stock, the current practice is to vacuum distill an atmospheric tower residuum from an appropriate crude oil as the first step. This step provides one or more raw stocks within the boiling range of about 450° F. to 1050° F. After preparation of a raw stock of suitable boiling range, it is extracted with a solvent, e.g., furfural, phenol, sulfalane, or chlorex, which is selective for aromatic hydrocarbons, and which removes undesirable components. The raffinate from solvent refining is then dewaxed, for example, by admixing with a solvent such as a blend of methyl ethyl ketone and toluene. The mixture is chilled to induce crystallization of the paraffin waxes which are then separated from the raffinate. Sufficient quantities of wax are removed to provide the desired pour point for the raffinate.

Other processes such as hydrofinishing or clay percolation may be used if needed to reduce the nitrogen and sulfur content or improve the color of the lubricating oil stock.

In recent years, catalytic techniques have become available for dewaxing of petroleum stocks. A process of that nature developed by Mobil Oil Corporation is described in U.S. Reissue Patent No. 28,398.

Many patents have now issued for catalytic dewaxing, specifically, catalytic dewaxing processes utilizing zeolites of the ZSM-5 type family. Such patents include U.S. Pat. Nos. 3,894,938; 3,755,138; 4,053,532; 3,956,102 and 4,247,388, assigned to Mobil Oil Corporation to name just a few. The entire contents of these patents are herein incorporated by reference.

Typically, the zeolite dewaxing catalyst is employed in intimate combination with one, or more, hydrogenation components such as tungsten, molybdenum, nickel, cobalt, or a noble metal such as platinum or palladium.

The dewaxing mechanism of catalytic hydrodewaxing is different from that of solvent dewaxing, resulting in some differences in chemical composition. Catalytically dewaxed products produce a haze on standing at 10° F. above specification pour point for more than twelve hours—known as the Overnight Cloud (ONC) formation. The extent of this ONC formation is less severe with solvent dewaxed oils. Although such an ONC formation does not affect the product quality of catalytically dewaxed oils, it is beneficial to reduce the Overnight Cloud (ONC) formation, since in some areas of the marketplace any increase in ONC is considered undesirable.

Thus, although some of the catalytic dewaxing processes of the prior art do, indeed, result in the production of lubricating oils of enhanced properties, nevertheless, the instant invention is concerned with an improved process wherein pour point specifications can be met and the resulting product will have improved overnight cloud performance and a lighter ASTM color than has heretofore been possible with prior art catalytic dewaxing operations.

SUMMARY OF THE INVENTION

It has now been found that catalytic hydrodewaxing of a lube stock is advantageously achieved by utilizing as catalyst a ZSM-5 crystalline aluminosilicate zeolite containing thereon a highly dispersed noble metal hydrogenation component. The recovered dewaxed lube so produced has improved overnight cloud performance and improved ASTM color compared with the lube obtained with ZSM-5 containing conventionally combined hydrogenation components at the conventional hydrodewaxing conditions such as set forth in U.S. Reissue Pat. No. 28,398.

DETAILED DESCRIPTION OF THE INVENTION

Figure 1:
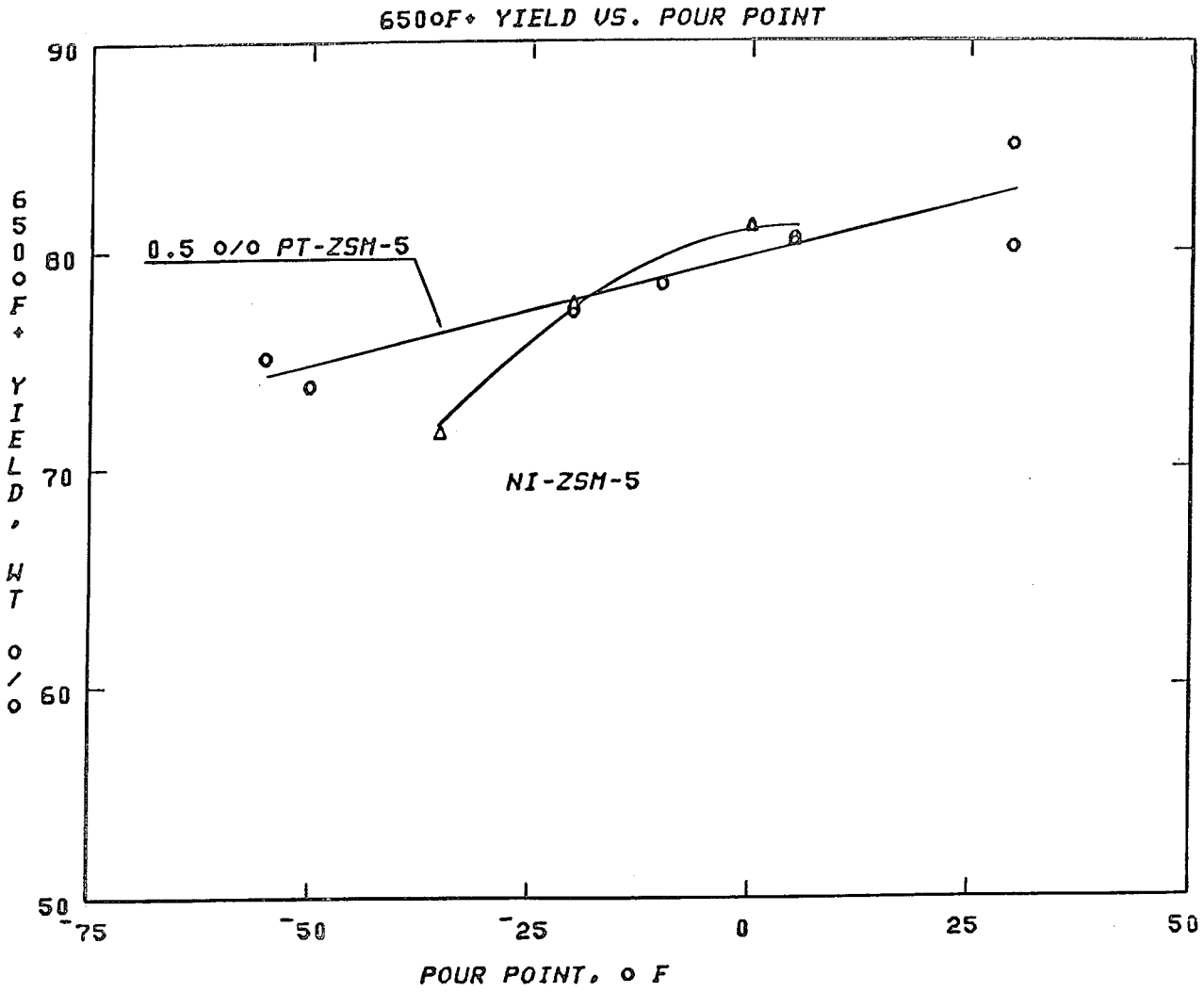
FIG. 1 is a graph comparing the performance of a dewaxing catalyst prepared in accordance with the present invention with a conventional dewaxing catalyst relative to the lube yield versus pour point achieved.

In the description which follows, particular reference will be made to the preparation of hydrocarbon lubricating oil stocks from suitable crude petroleum fractions. A suitable crude petroleum, for purposes of this invention, is one from which may be prepared a dewaxed lubricating oil having a viscosity index of at least about 85, and a pour point not greater than +20° F., by conventional methods of distillation, solvent refining and dewaxing. Also contemplated within the scope of this invention for use as feed thereto is any hydrocarbon lubricating oil stock boiling within the range of from about 450° F., and preferably from about 600° F. to 1050° F., and capable of yielding significant amounts of dewaxed lubricating oil having a V.I. of at least about 85 and a pour point not greater than +20° F. Thus, hydrocracked petroleum oils having the foregoing characteristics are included with the scope of this invention, as well as are other process heavy oils derived from tar sands, coal, or from other sources. The boiling points herein referred to are boiling points at atmospheric pressure, and may be determined by vacuum assay in the manner known to those skilled in the art.

Typically, the raw stock herein above described is solvent refined by countercurrent extraction with at least an equal volume of a selective solvent such as furfural. It is preferred to use 1.5 to 2.5 volumes of solvent per volume of oil. The raffinate is subjected to catalytic dewaxing by mixing with hydrogen and contacting at 500° F. to about 700° F. with a catalyst containing a noble metal and a ZSM-5 type zeolite, in which the noble metal is highly dispersed within the zeolite component. The catalytic dewaxing is conducted at a liquid hourly space velocity (LHSV) of 0.1 to 5.0 volumes of charge oil per volume of catalyst per hour.

In some instances, it may be desirable to partially dewax the solvent-refined stock by conventional solvent dewaxing techniques, say to a pour point from 10° F. to about 50° F., and preferably to a pour point greater than about +20° F., prior to catalytic dewaxing. The higher melting point waxes so removed are those of greater hardness and higher market value than the waxes removed in taking the product to a still lower pour point.

Catalytic dewaxing may be conducted by contacting the feed to be dewaxed with a fixed stationary bed of catalyst, with a fixed fluidized bed, or with a transport bed, as desired. A preferred configuration is a trickle-bed operation in which the feed is allowed to trickle through a stationary fixed bed, preferably in the presence of hydrogen.

The crystalline aluminosilicate zeolite which is useful as the dewaxing catalyst of this invention comprises ZSM-5 containing an active noble metal hydrogenation component.

The synthesis and characteristics of zeolite ZSM-5 are described in U.S. Pat. No. 3,702,886, issued Nov. 14, 1972, the disclosure of which is incorporated herein by reference.

The crystalline aluminosilicate zeolite dewaxing catalyst is employed in intimate combination with between about 0.1 and about 25 wt.% of a noble meal hydrogenation component. Platinum is the preferred hydrogenation metal. Other noble metals such as palladium, iridium, osmium and the like are also suitable for use as the hydrogenation component. The preferred platinum hydrogenation component can be impregnated into or onto the zeolite such as, for example, by treating the zeolite with a platinum metal-containing ion. Thus, suitable platinum compounds include chloroplatinic acid, platinous chloride and various compounds containing the platinum amine complex. The compounds of the useful platinum metals can be divided into compounds in which the metals are present in the cation of the compound and compounds in which the metal is present in the anion of the compound. Both types of compounds which contain the metal in the ionic state can be thus used. A solution in which platinum metals are in the form of a cation or cation complex, e.g. $Pt(NH_3)_4Cl_2$ is particularly useful.

In order to achieve the improved overnight cloud performance and improved ASTM color of the dewaxed lube product, in accordance with this invention, it is necessary that the noble metal hydrogenation component be highly dispersed within the ZSM-5 dewaxing catalyst. The amount of dispersion of the noble metal is conventionally defined as the number of surface metal atoms divided by the total number of metal atoms in the catalyst particle. A more precise description of the nature of supported-metal catalysts is set forth in Chemical and Catalytic Reaction Engineering, (McGraw-Hill, 1976), by James J. Carberry, pages 423–439.

In accordance with the present invention, the noble metal dispersion within the zeolite catalyst will be at least about 50 percent and, preferably, at least about 70 percent. An advantageous technique to determine the amount of noble metal dispersion within the zeolite dewaxing catalyst is characterized as temperature programmed desorption (TPD). TPD consists of exposing the catalyst containing the hydrogenation component to hydrogen for a given period of time and subsequently desorbing the hydrogen by providing sufficient thermal energy for desorption. Due to the different engeriges required for desorption of hydrogen from the noble metal and the zeolite support, the hydrogen from each is desorbed in a unique temperature range. Thus, as surface catalysis involves, by definition only those sites exposed to reactants, knowing the total metals loading and the temperature range at which hydrogen is desorbed from the noble metal hydrogenation component, by collecting the desorbed hydrogen in a calibrated vessel within the proper temperature range and knowing the stoichiometry of chemisorption of hydrogen to supported noble metal, the dispersion of hydrogenation component within the zeolite catalyst can be calculated. TPD is described in an article entitled "The Stoichiometry of Hydrogen and CO Chemisorption on Ir/$\gamma$-$Al_2O_3$", Journal of Catalysis, 78, pp. 319–326, (1982), by S. Krishnamurthy, G. R. Landolt and H. J. Schoennagel.

One advantageous method of achieving the desired noble metal dispersion is to pretreat the ZSM-5 dewaxing catalyst with gaseous carbon dioxide prior to impregnation with the solution containing the noble metal. The carbon dioxide treatment can be generally effected under room temperature conditions utilizing a carbon dioxide pressure in the range of between about 100 kPa (0 psig) and 450 kPa (50 psig). The zeolite can be generally treated with carbon dioxide for a period between about 1 minute and about 48 hours, and more usually between about 1 minute and about 3 hours. It is to be noted that the time of gas treatment and the gauge pressure set forth above are not considered critical, it being only necessary that the zeolite be exposed to a gaseous carbon dioxide atmosphere for a sufficient period of time and under sufficient pressure to become substantially saturated. The gas initially contained in the pores of the zeolite, which will ordinarily be air, may be replaced by sweeping the zeolite particles with gaseous carbon dioxide for a sufficient period of time to replace substantially all of the air in the pores of the zeolite with carbon dioxide. It is generally preferred, however, to subject the porous zeolite to a vacuum, thereby removing the air or other gas contained therein and subsequently contact the evacuated particles with gaseous carbon dioxide. The ZSM-5 catalyst, after treatment with carbon dioxide, is thereafter impregnated with a solution of suitable noble metal compounds. In one preferred embodiment, the zeolite, after pretreatment, can be maintained in an atmosphere of gaseous carbon dioxide during the subsequent impregnation. Desirably, the zeolite which has undergone pretreatment with gaseous carbon dioxide should be brought into contact with the impregnating solution containing noble metal immediately after such pretreatment to insure the optimum results of this invention.

The following Examples will serve to illustrate the process of the invention without limiting the same.

EXAMPLE 1

In this Example a comparison was made of lube oils dewaxed using a highly dispersed Pt-ZSM-5 dewaxing catalyst as prepared in accordance with this invention and a ZSM-5 dewaxing catalyst containing platinum, which latter catalyst was not pretreated to provide a Pt dispersion at a level within the scope of the present invention. In all cases, the zeolite catalysts were composites of 65% ZSM-5, 35% alumina.

A dewaxing catalyst was prepared in accordance with the present invention by flushing unsteamed HZSM-5 with $CO_2$ for 5–10 minutes, followed by chloroplatinic acid-impregnation to 0.5% platinum by weight. The catalyst had a platinum dispersion of 0.75%.

A separate dewaxing catalyst was prepared by impregnating unsteamed HZSM-5 with platinum tetraamine to 2% platinum by weight. The platinum impregnation was not preceded by any $CO_2$ pretreatment. The catalyst had a platinum dispersion of 0.23.

The catalysts were used separately to dewax a light neutral hydrocarbon feedstock. The catalysts were loaded into separate fixed-bed reactors and reduced in-situ at 400 psig $H_2$ at 900° F. for 1 hour. The feed was pumped into the reactor along with hydrogen after the reactor temperature was lowered to the desired setting.

The results of dewaxing in the presence of the 2% platinum catalyst and the highly dispersed platinum catalyst of the present invention are shown in Tables 1 and 2, respectively. As can be seen, while both catalysts improve the ASTM color substantially, the overnight cloud (ONC) performance utilizing the highly dispersed platinum catalyst of the present invention was superior to the 2% Pt-ZSM-5 even though the platinum loading was higher in the latter catalyst. ONC was determined by a standard Nephelometric instrument. The instrument measured the cloud produced after samples were maintained stationary for at least 16 hours, at 30° F.

EXAMPLE 2

The highly dispersed Pt-ZSM-5 dewaxing catalyst utilized in Example 1 was compared with a NiZSM-5 catalyst relative to the properties obtained upon dewaxing the same light neutral stock used in Example 1. The results of dewaxing in the presence of the NiZSM-5 catalyst is shown in Table 3.

Compared to the NiZSM-5, the platinum catalyst prepared in accordance with the present invention improved the overnight cloud performance substantially. The product formed using the highly dispersed platinum catalyst clearly passed the ONC test. Thus, it can be seen that the ONC was 2 at about a 5° F. pour point compared to 17 for the NiZSM-5. A product with the ONC less than 10 passes the test.

It can also be observed that the products produced with the platinum catalyst of the present invention have an ASTM color of 0.5 compared to the ASTM color of 1.5 to 4.5 for the nickel ZSM-5 catalyst. Clearly, the highly dispersed platinum catalyst significantly improved the color of the dewaxed products.

Figure 2:
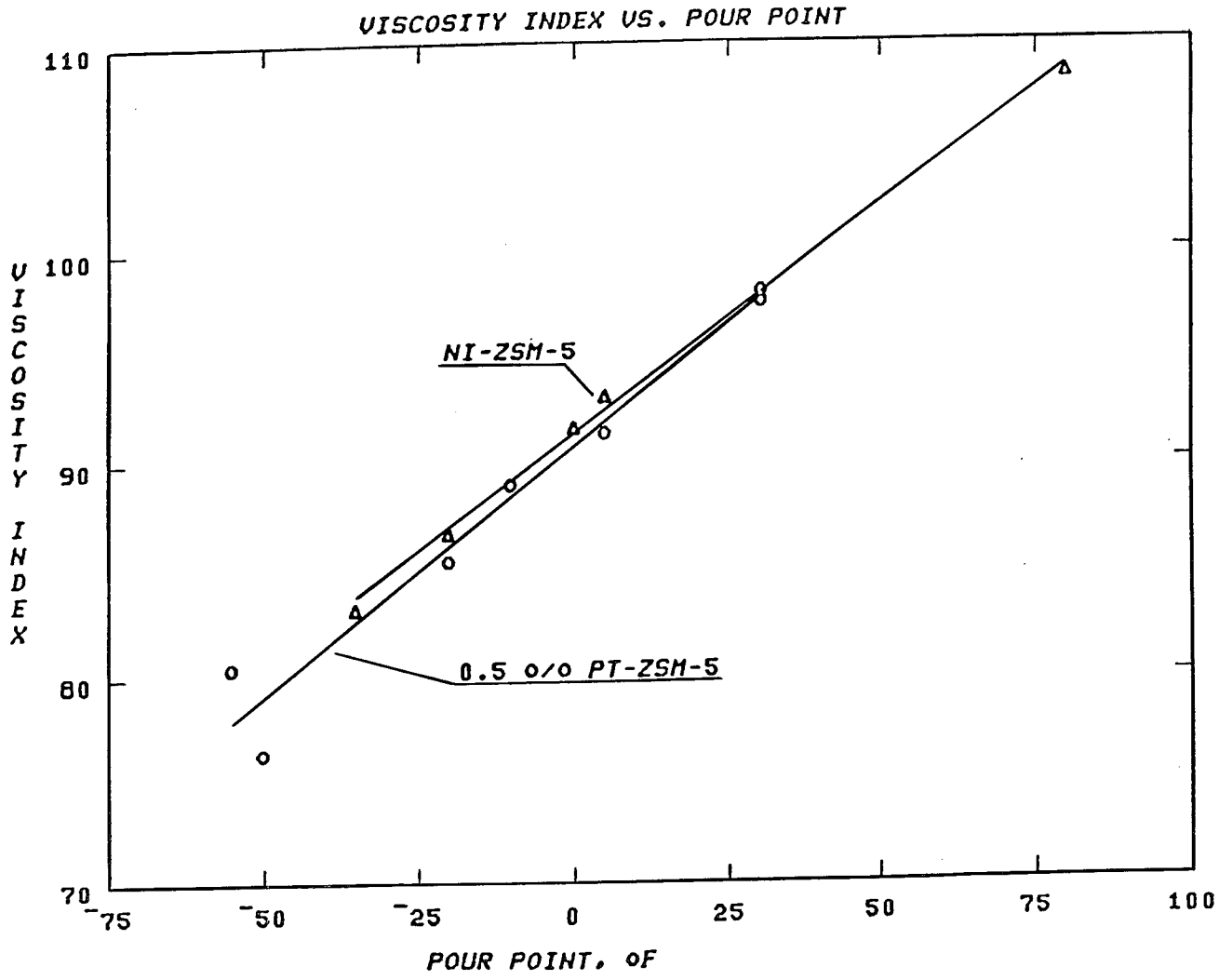
FIG. 2 is a graph comparing a dewaxing catalyst prepared in accordance with the present invention with a conventional dewaxing catalyst relative to the viscosity obtained at various pour points.

The 650° F.+ yield and viscosity index are applied against pour point in FIGS. 1 and 2, respectively. Little or no difference was observed in V.I. and the 650° F.+ yield among the platinum and nickel catalyst.

Figure 3:
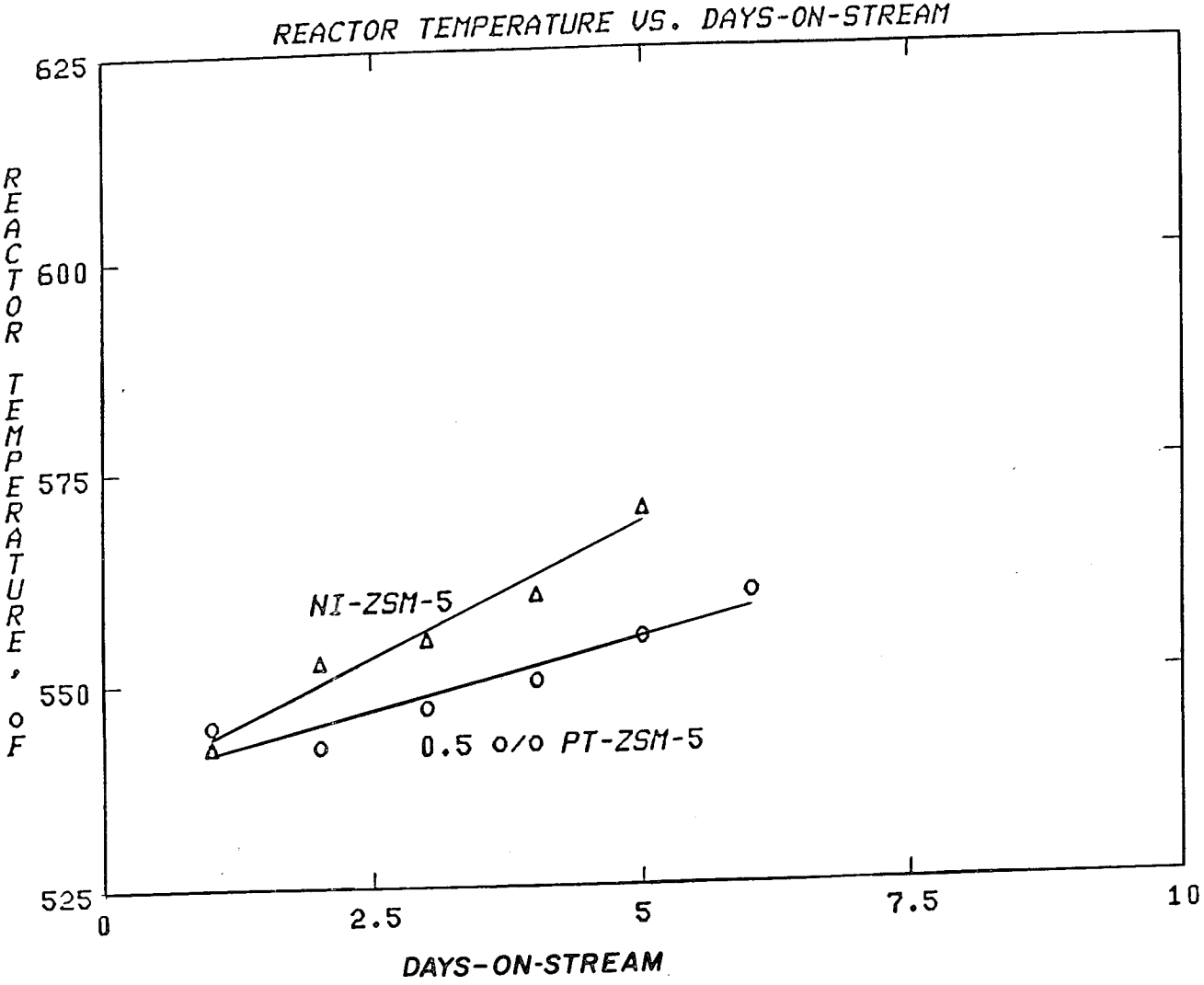
FIG. 3 is a graph comparing the activity of a catalyst prepared in accordance with the present invention with a conventional dewaxing catalyst.

The reaction temperature versus days-on-stream plot for costant pour point of 20° F. is shown in FIG. 3. In FIG. 3, the run data were correlated based on 1° F. in reaction temperature for 2° F. in pour point. Over a 7 day period, the highly dispersed platinum catalyst aged at 3.0° F. per day, compared to 6.3° F. per day for nickel-ZSM-5/$Al_2O_3$.

A property of the dewaxed oils at −35° F. pour point was made for the highly dispersed platinum catalyst, and 2% Pt-ZSM-5 dewaxing catalyst of Example 1 and the NiZSM-5 catalyst of Example 2. A summary of the property comparison is shown in Table 4.

Both the 0.5% and 2% Pt-ZSM-5 catalyst reduced the ASTM color. At 5° F. pour point, the ASTM color of the dewaxed oils is reduced from 3.0 for the nickel catalyst to 0.5 for the highly dispersed platinum catalyst of the present invention. However, it can be seen that the overnight cloud performance using the highly dispersed platinum catalyst of the present invention was significantly improved over the other catalysts.

TABLE 1

| | 2% Pt—ZSM-5/$Al_2O_3$ (Platinum Dispersion - 23%) | | | | | | | | |
|---|---|---|---|---|---|---|---|---|---|
| Feed | Run # | | | | | | | | |
| Charge | 1 | 2 | 3 | 4 | 5 | 6 | 7 | 8 | 9 |
| Temp., °F. | 550 | 550 | 525 | 510 | 550 | 580 | 580 | 600 | 580 |
| Press., psig | 400 | 400 | 400 | 400 | 400 | 400 | 400 | 400 | 400 |
| Gas | $H_2$ | $H_2$ | $H_2$ | $H_2$ | $H_2$ | $H_2$ | $H_2$ | $H_2$ | $H_2$ |
| Circ., SCF/bbl | 2551 | 1953 | 2427 | 2427 | 2604 | 2631 | 2604 | 2315 | 2778 |

TABLE 1-continued

| | Feed Charge | 2% Pt—ZSM-5/$Al_2O_3$ (Platinum Dispersion - 23%) Run # 1 | 2 | 3 | 4 | 5 | 6 | 7 | 8 | 9 |
|---|---|---|---|---|---|---|---|---|---|---|
| TOS, days | | 3 | 4 | 5 | 6 | 7 | | | | |
| Run Time, hrs. | | 21 | 19 | 21 | 22 | 21 | 23 | 23.5 | 23 | 24.5 |
| LHSV | | 0.98 | 1.28 | 1.03 | 1.03 | 0.96 | 0.95 | 0.96 | 1.08 | 0.90 |
| Mat. Bal., % | | 97.2 | 98.5 | 100.9 | 101.2 | 98.1 | 95.4 | 99.2 | 98.9 | 99.2 |
| Yield, wt. % | | | | | | | | | | |
| $C_1 + C_2$ | | 0.43 | 0.40 | 0.19 | 0.13 | 0.29 | 0.94 | 0.72 | 0.76 | 0.73 |
| $C_3$ | | 5.57 | 4.44 | 2.48 | 0.93 | 4.68 | 9.57 | 9.36 | 9.58 | 9.36 |
| $C_4$ | | 5.71 | 4.47 | 3.44 | 1.74 | 4.95 | 6.86 | 7.60 | 6.39 | 8.21 |
| $C_5$ | | 2.41 | 1.99 | 2.08 | 1.58 | 2.11 | 3.06 | 2.70 | 1.94 | 4.40 |
| $C_6$-650° F. | | 6.16 | 5.91 | 4.70 | 3.27 | 6.24 | 4.66 | 6.05 | 5.40 | 5.76 |
| 650° F.+ Lube | 100 | 79.72 | 82.79 | 87.11 | 92.35 | 81.73 | 74.91 | 73.57 | 75.93 | 71.54 |
| Specific Gravity | .8774 | .8884 | .8842 | .8808 | .8790 | .8861 | .8892 | .8886 | .8882 | .8868 |
| API° | 29.8 | 27.8 | 28.5 | 29.1 | 29.5 | 28.2 | 27.6 | 27.7 | 27.8 | 28.1 |
| Pour Point, °F. | 85 | 25 | 35 | 70 | 75 | 40 | −50 | −55 | −50 | −35 |
| Cloud Point, °F. | 120 | 46 | 76 | 88 | NA | 56 | <−65 | <−65 | <−65 | −58 |
| KV at 100° F. | | 57.69 | 47.94 | 42.69 | 39.57 | 50.82 | 61.68 | 58.71 | 58.33 | 57.76 |
| KV at 210° F. | | 7.239 | 6.547 | 6.252 | 6.080 | 6.683 | 7.164 | 7.046 | 7.028 | 7.024 |
| KV at 40° C. | | 51.74 | 43.20 | 38.63 | 35.91 | 45.69 | 55.04 | 52.5 | 52.17 | 51.69 |
| KV at 100° C. | 5.341 | 7.058 | 6.389 | 6.105 | 5.940 | 6.519 | 6.980 | 6.867 | 6.850 | 6.847 |
| SUS at 100° F. | | 268 | 223 | 199 | 184.8 | 236 | 286 | 273 | 271 | 268 |
| SUS at 210° F. | | 49.9 | 47.6 | 46.7 | 46.1 | 48.1 | 49.6 | 49.3 | 49.2 | 49.2 |
| Viscosity Index | | 91.5 | 94.8 | 102.8 | 108.7 | 90.5 | 77.1 | 80.7 | 81.1 | 82.7 |
| Sulfur, wt. % | 0.76 | 0.98 | 0.86 | 0.80 | 0.82 | 0.90 | 0.83 | 0.80 | 0.79 | 0.83 |
| Nitrogen, ppm | 45 | 59 | 45 | 46 | 45 | 49 | 30 | 45 | 47 | 48 |
| Hydrogen, wt. % | 13.70 | 13.28 | 13.52 | 13.54 | 13.47 | 13.46 | 13.51 | 13.42 | 13.31 | 13.47 |
| Overnight Cloud | NA | >20 | >20 | >20 | >20 | >20 | 2 | 3 | 2 | 10 |
| ASTM Color | <1.0 | <1.5 | <1.0 | <1.0 | <1.0 | 0.5 | <0.5 | <0.5 | <0.5 | <0.5 |

TABLE 2

| | 0.5% Pt—ZSM-5 (Platinum Dispersion - 75%) Run # 1 | 2 | 3 | 4 | 5 | 6 | 7 |
|---|---|---|---|---|---|---|---|
| Temperature, °F. | 580 | 580 | 565 | 565 | 550 | 558 | 580 |
| Pressure, psig | 400 | 400 | 400 | 400 | 400 | 400 | 400 |
| Gas | $H_2$ | $H_2$ | $H_2$ | $H_2$ | $H_2$ | $H_2$ | $H_2$ |
| Circulation, SCF/bbl | 2427 | 2551 | 2053 | 2493 | 2475 | 2193 | 2577 |
| Time on Stream, days | 1 | 2 | 3 | 4 | 5 | 6 | 7 |
| Run Time, hrs. | 24 | 25 | 22 | 25 | 22 | 24 | 19 |
| LHSV | 1.03 | 0.98 | 1.28 | 1.00 | 1.01 | 1.14 | 0.97 |
| Material Balance, % | 96.9 | 97.1 | 97.6 | 97.4 | 97.1 | 98.1 | 96.1 |
| Yields, wt. % | | | | | | | |
| $C_1 + C_2$ | 0.7 | 0.8 | 0.2 | 0.5 | 0.4 | 0.3 | 0.66 |
| $C_3$ | 8.7 | 8.0 | 4.4 | 4.6 | 3.6 | 1.7 | 6.60 |
| $C_4$ | 6.4 | 6.3 | 5.4 | 4.9 | 5.0 | 3.2 | 5.92 |
| $C_5$ | 2.0 | 2.5 | 1.5 | 2.7 | 3.1 | 3.3 | 2.73 |
| $C_6$-650° F. | 8.2 | 7.2 | 8.8 | 8.8 | 7.7 | 6.4 | 6.76 |
| 650° F.+ Lube | 73.9 | 75.2 | 80.7 | 78.6 | 80.3 | 85.2 | 77.33 |
| Specific Gravity | .8904 | .8913 | .8854 | .8868 | .8810 | .8814 | .8885 |
| API° | 27.4 | 27.3 | 28.3 | 28.1 | 29.1 | 29.0 | 27.5 |
| Pour Point, °F. | −50 | −55 | 5 | −10 | 30 | 30 | −20 |
| Cloud Point, °F. | −65 | −65 | 8 | 0 | 30 | 36 | −34 |
| KV at 100° F. | 61.56 | 58.21 | 50.42 | 51.90 | 45.72 | 46.19 | 55.00 |
| KV at 210° F. | 7.143 | 7.008 | 6.673 | 6.736 | 6.423 | 6.454 | 6.898 |
| KV at 40° C. | 54.93 | 52.06 | 45.35 | 46.63 | 41.27 | 41.68 | 49.31 |
| KV at 100° C. | 6.959 | 6.826 | 6.505 | 6.569 | 6.265 | 6.294 | 6.726 |
| SUS at 100° F. | 286 | 270 | 234 | 241 | 213 | 215 | 256 |
| SUS at 210° F. | 49.6 | 49.1 | 48.1 | 48.3 | 47.2 | 47.3 | 48.8 |
| Viscosity Index | 76.5 | 80.6 | 91.5 | 89.1 | 98.1 | 97.6 | 85.9 |
| Sulfur, wt. % | 0.88 | 0.87 | .91 | .92 | 0.83 | .81 | 0.88 |
| Nitrogen, ppm | 31 | 44 | 42 | 43 | 40 | 39 | 46 |
| Hydrogen, wt. % | 13.36 | 13.36 | 13.56 | 13.49 | 13.65 | 13.50 | 13.88 |
| Overnight Cloud | 0 | 1 | 2 | 2 | >20 | >20 | 6 |
| ASTM Color | 0.5 | 0.5 | 0.5 | 0.5 | 0.5 | 0.5 | L0.5 |

TABLE 3

| | Feed Charge | NiZSM-5 Run # 1 | 2 | 3 | 4 | 5 |
|---|---|---|---|---|---|---|
| Temperature, °F. | | 550 | 580 | 525 | 580 | 580 |
| Pressure, psig | | 400 | 400 | 400 | 400 | 400 |

TABLE 3-continued

| | Feed Charge | NiZSM-5 Run # 1 | 2 | 3 | 4 | 5 |
|---|---|---|---|---|---|---|
| Gas | | $H_2$ | $H_2$ | $H_2$ | $H_2$ | $H_2$ |
| Circulation, SCF/bbl | | 2500 | 2500 | 2577 | 2427 | 2404 |
| Time on Stream, days | | 1 | 2 | 3 | 4 | 5 |
| Run Time, hrs. | | 21 | 21.5 | 24 | 22 | 26 |
| LHSV | | 1.00 | 1.00 | 0.97 | 1.03 | 1.04 |
| Material Balance, % | | 98.3 | 97.1 | 101.0 | 97.5 | 97.5 |
| Yields, wt. % | | | | | | |
| $C_1 + C_2$ | | 0.3 | 0.4 | 0.3 | 0.5 | 0.5 |
| $C_3$ | | 5.0 | 8.1 | 1.0 | 4.9 | 3.6 |
| $C_4$ | | 6.1 | 11.1 | 2.6 | 5.6 | 3.8 |
| $C_5$ | | 1.5 | 1.8 | 1.0 | 3.3 | 2.4 |
| $C_6$-650° F. | | 6.6 | 6.8 | 3.7 | 8.1 | 8.4 |
| 650° F.+ Lube | 100 | 80.6 | 71.8 | 91.4 | 77.7 | 81.3 |
| Specific Gravity | .8774 | .8878 | .9819 | .8784 | .8891 | .8857 |
| API° | 29.8 | 27.9 | 27.2 | 29.6 | 27.6 | 28.3 |
| Pour Point, °F. | 85 | 5 | −35 | 80 | −20 | 0 |
| Cloud Point, °F. | 120 | 22 | −40 | 90 | 6 | 18 |
| KV at 100° F. | | 58.43 | 58.83 | 39.96 | 54.46 | 50.35 |
| KV at 210° F. | | 7.346 | 7.113 | 6.113 | 6.879 | 6.673 |
| KV at 40° C. | | 52.42 | 52.63 | 36.26 | 48.85 | 5.29 |
| KV at 100° C. | 5.341 | 7.162 | 6.933 | 5.975 | 6.708 | 6.510 |
| SUS at 100° F. | | 271 | 273 | 186.6 | 253 | 234 |
| SUS at 210° F. | | 50.2 | 49.5 | 46.3 | 48.7 | 48.1 |
| Viscosity Index | | 93.2 | 83.3 | 108.5 | 86.8 | 91.7 |
| Sulfur, wt. % | 0.76 | 0.98 | 1.06 | 0.87 | 0.97 | 0.93 |
| Nitrogen, ppm | 45 | 44 | 49 | 41 | 46 | 52 |
| Hydrogen, wt. % | 13.70 | 13.37 | 13.28 | 13.71 | 13.61 | 13.35 |
| Overnight Cloud | NA | 17 | 16 | >20 | 20 | >20 |
| ASTM Color | <1.0 | 3.0 | <3.0 | <4.5 | <1.5 | <1.5 |

TABLE 4

Property Comparison of Dewaxed Oils at −35° Pour

| Catalyst | NiZSM-5 | 0.5% Pt—ZSM-5** | | | 2% PT—ZSM-5 |
|---|---|---|---|---|---|
| Platinum Dispersion, % | — | 75 | | | 23 |
| Pour Point, °F. | −35 | −50 | −20 | −35* | −35 |
| API° | 27.2 | 27.4 | 27.5 | 27.4* | 28.1 |
| Viscosity Index | 83.3 | 76.5 | 85.9 | 81.2* | 82.7 |
| ONC | 16 | 0 | 6 | 3* | 10 |
| ASTM Color | <3.0 | 0.5 | <0.5 | 0.5* | <0.5 |

*Estimated

**$CO_2$-Pretreatment before chloroplatinic acid-impregnation

What is claimed is:

1. A process for producing an improved lubricant basestock with a reduced tendency to form a haze after standing overnight at subambient temperatures, said process comprising contacting a waxy hydrocarbon fraction boiling within the approximate range of 450° F. to 1050° F. and hydrogen at dewaxing conditions with a catalyst comprising ZSM-5 crystalline aluminosilicate zeolite having contained thereon an active noble metal hydrogenation component present as a noble metal dispersion of at least about 0.50 and recovering a dewaxed oil product.

2. The process of claim 1 wherein said dewaxing conditions include a temperature between about 500° F. and about 700° F., a pressure between about 100 and 3000 psig at a liquid hourly space velocity between about 0.1 and about 10.

3. The process of claim 1 wherein said zeolite catalyst is treated with gaseous $CO_2$ prior to the inclusion of said noble metal.

4. The process of claim 1 wherein said noble metal comprises platinum and said zeolite catalyst contains between about 0.1 and about 25 wt.% of said platinum hydrogenation component.

5. The process of claim 4 wherein said zeolite catalyst contains about 0.2–1.0 wt.% platinum.

6. The process of claim 5 wherein said platinum dispersion is at least about 0.70.

7. The process of claim 4 wherein said platinum is impregnated into said zeolite by treating the zeolite with a platinum metal-containing ion.

8. The process of claim 7 wherein said platinum metal-containing ion is provided from suitable platinum compounds selected from the group consisting of chloroplatinic acid, platinous chloride and compounds containing a platinum amine complex.

9. The process of claim 8 wherein said platinum amine complex comprises tetraamineplatinum chloride.

* * * * *

UNITED STATES PATENT AND TRADEMARK OFFICE

CERTIFICATE OF CORRECTION

PATENT NO. : 4,474,618

DATED : October 2, 1984

INVENTOR(S) : JEFFREY H. YEN, ARTHUR W. CHESTER, & WILLIAM E. GARWOOD

It is certified that error appears in the above-identified patent and that said Letters Patent is hereby corrected as shown below:

Column 5, line 47, delete "%".

Column 6, line 41, "costant" should be --constant--.

Signed and Sealed this

*Fourteenth* Day of *May 1985*

[SEAL]

*Attest:*

DONALD J. QUIGG

*Attesting Officer* *Acting Commissioner of Patents and Trademarks*